United States Patent [19]

Mentzer

[11] Patent Number: 4,512,482

[45] Date of Patent: Apr. 23, 1985

[54] MULTIPLE OFFSET CRANE BOOM EXTENSION

[75] Inventor: William R. Mentzer, Shady Grove, Pa.

[73] Assignee: Kidde, Inc., Saddle Brook, N.J.

[21] Appl. No.: 466,625

[22] Filed: Feb. 15, 1983

Related U.S. Application Data

[63] Continuation-in-part of Ser. No. 371,133, Apr. 23, 1982.

[51] Int. Cl.[3] ..... B66C 23/62

[52] U.S. Cl. ..... 212/188; 212/177; 212/266

[58] Field of Search ..... 212/177, 187, 188, 266; 52/148–152, 117

[56] References Cited

U.S. PATENT DOCUMENTS

| | | | |
|---|---|---|---|
| 1,748,365 | 2/1930 | Remde | 212/187 |
| 2,049,352 | 7/1936 | Camp | 52/148 |
| 3,182,371 | 5/1965 | Pieper | 52/149 |
| 3,732,988 | 5/1973 | Lamer | 212/187 |
| 3,794,296 | 2/1974 | Hasstedt | 212/188 |
| 3,968,884 | 7/1976 | Johnson et al. | 212/188 |
| 4,091,936 | 5/1978 | Wuerflein et al. | 212/177 |

FOREIGN PATENT DOCUMENTS

| | | | |
|---|---|---|---|
| 1357100 | 6/1974 | United Kingdom | 212/177 |

*Primary Examiner*—Trygve M. Blix
*Assistant Examiner*—Thomas J. Brahan
*Attorney, Agent, or Firm*—Brady, O'Boyle & Gates

[57] ABSTRACT

A crane boom extension or jib is held on the nose of the boom by a single fixed length self-adjusting cable loop which extends around an arcuate guide attachable at several different locations to an inclined plane mounting bracket on the jib near its outer end. The mere repositioning of the guide on the inclined plane mounting bracket allows the jib to assume several different angularly offset positions relative to the axis of the boom without other adjustments. The inclined plane mounting bracket establishes the plane in which the cable loop lies in all adjusted positions of the jib. The arrangement is convenient, safe and simplified.

4 Claims, 6 Drawing Figures

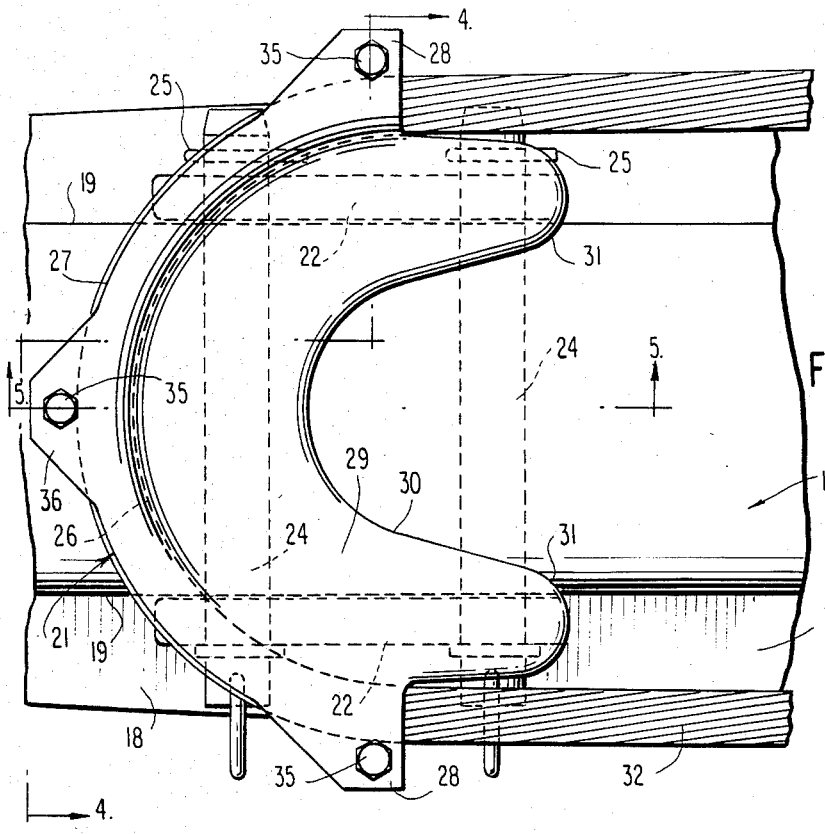
FIG. 3
FIG. 2
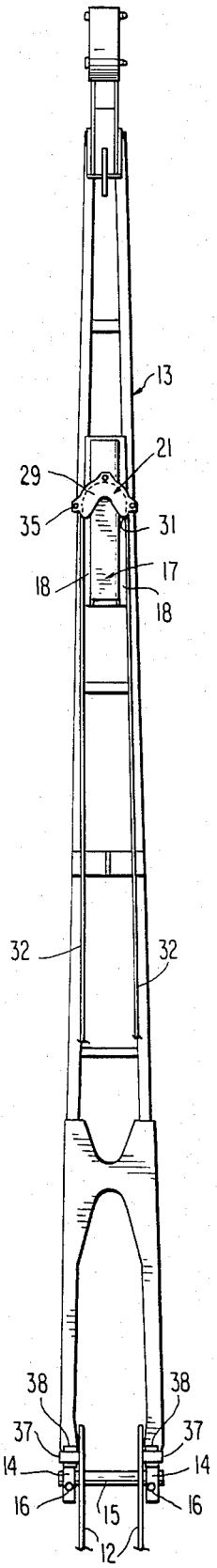
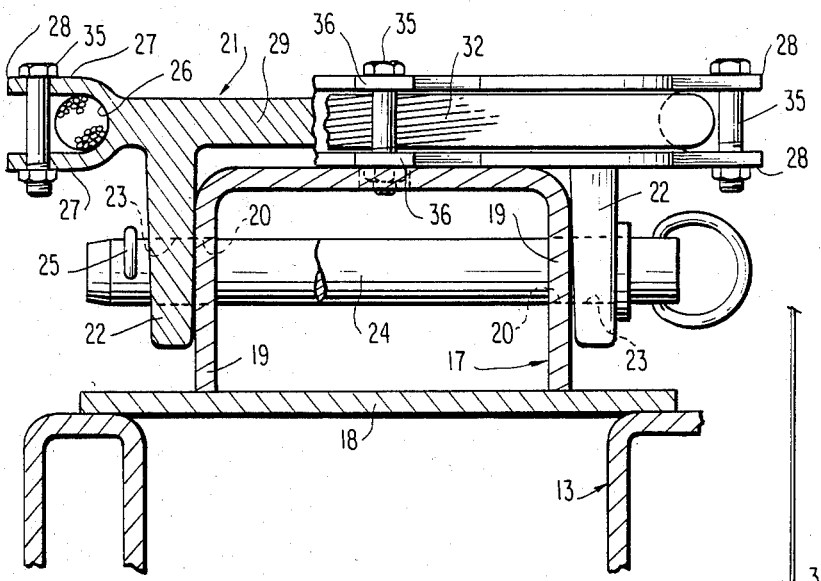
FIG. 4
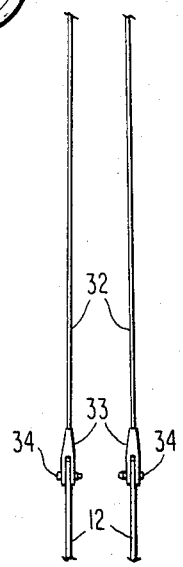
FIG. 2A

MULTIPLE OFFSET CRANE BOOM EXTENSION

CROSS-REFERENCE TO RELATED APPLICATION

This application is a continuation-in-part of prior copending application Ser. No. 06/371,133, filed Apr. 23, 1982.

BACKGROUND OF THE INVENTION

As noted in the above-referenced prior application, existing arrangements which permit angular offsetting of crane boom extensions or jibs are varied and not entirely satisfactory from the standpoint of convenience of use, simplicity of construction and safety. Accordingly, the main objective of this invention is to improve on all known devices which enable angular offsetting of boom jibs particularly in these areas of convenience of installation and operation, simplicity of construction and safety of the operator or installer of the means which supports the jib in its several offset positions.

More particularly, it is an object of the invention to provide an offsettable extension or jib for crane booms which is held in each of its several offset positions by a single fixed length self-adjusting cable loop or guy. The loop or guy has its ends attached to the nose assembly of the boom and extends around a fixed arcuate guide mounted on an inclined plane bracket which is attached to the jib relatively close to its outer end, the inclination of the mounting bracket relative to the axis of the jib defining the plane occupied by the cable loop in all adjusted positions of the jib and also establishing a constant angle between the cable loop and the jib axis in all offset positions of the jib.

A major feature of the device is the ability of the jib to assume its several different angular positions relative to the boom axis merely by repositioning the cable loop guide and fixing it in a corresponding number of positions on the inclined plane bracket.

The device is safer than prior art devices for the same general purpose inasmuch as the use and installation of separable jib support links and guy cables is eliminated. These prior art components have generally required the installer or operator to climb onto the crane boom while it is in a depressed position to install links or cables associated with the jib. The present device does not require this because of the fact that the inclined plane bracket on which the multiple position cable loop guide is held is located near the forward end of the jib and consequently is very close to ground level when the crane boom is in its maximum depressed position. Therefore, an installer standing on the ground can place the cable loop around the arcuate guide and can also adjust the position of the guide on the inclined plane guide mounting bracket with complete safety.

Other features and advantages of the invention will become apparent during the course of the following detailed description.

BRIEF DESCRIPTION OF THE DRAWINGS

FIG. 2 is a plan view of the jib, with parts broken away, on a reduced scale.

FIG. 2A is a fragmentary plan view of a cable loop and its connections with a crane boom nose assembly.

FIG. 3 is an enlarged fragmentary plan view of the jib showing details of a cable loop guide and associated parts.

FIG. 4 is a vertical section taken on line 4—4 of FIG. 3.

DETAILED DESCRIPTION

Figures 1, 5:
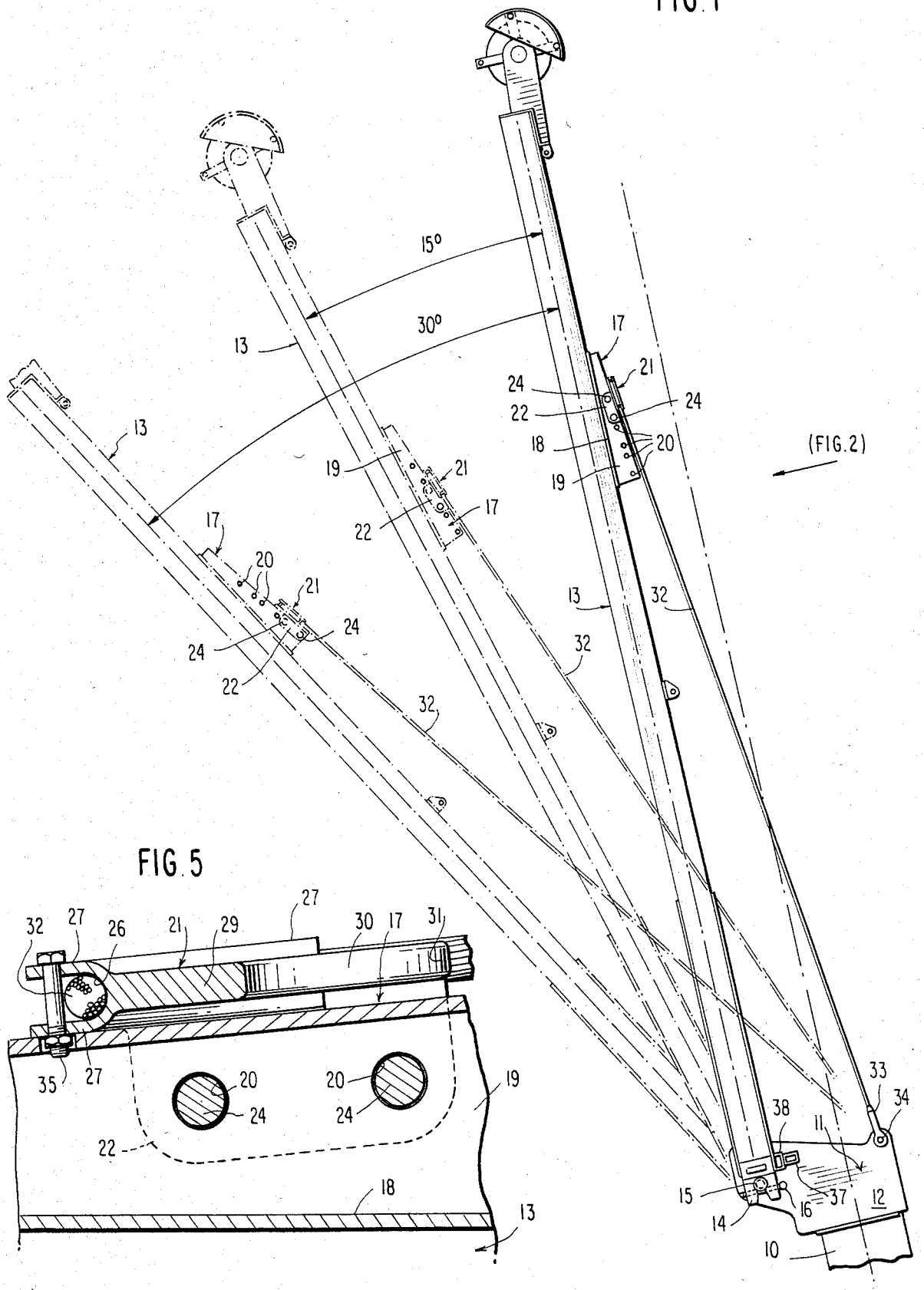
FIG. 1 is a side elevation of a multiple offset crane boom jib according to the invention showing two operational positions of the jib in broken lines.
FIG. 5 is a fragmentary vertical section taken on line 5—5 of FIG. 3.

Referring to the drawings in detail, wherein like numerals designate like parts, a conventional telescoping crane boom 10, FIG. 1, includes a nose assembly 11 having parallel side plates 12, FIGS. 2 and 2A. A boom extension or jib 13 according to the present invention is of the general type shown in U.S. Pat. No. 3,366,250. Such a jib has spaced bifurcated inner end mounting extensions 14 which straddle the nose assembly side plates 12 and pivotally engage a cross shaft 15 of the nose assembly, the extensions 14 being detachably connected to the cross shaft 15 by removable pins 16.

Jibs of this type, when detached from the boom nose assembly, may be stowed on support brackets along the bottom of the crane boom or may be swung on the shaft 15 to such a bottom stowed position as shown in U.S. Pat. No. 3,366,250. However, the present invention is not intended to be limited to a bottom stowable jib and could be employed with other forms of jibs and boom extensions, such as swing-around side stowable jib of the type shown in the above-referenced prior application.

In accordance with the invention, the jib 13 near its forward end and on its upper side has fixed thereto an inclined plane wedge-like mounting bracket 17, preferably of inverted U-cross section, including an attached base plate 18 which rests directly on the jib 13. The parallel side walls 19 of the inclined plane mounting bracket each contain three spaced pairs of apertures 20, whose purpose will be fully described.

A cable guide member 21, preferably a casting, rests on the upper face of the bracket 17 and includes a pair of spaced depending side bars 22 which straddle the bracket 17, as best shown in FIG. 4. The bars 22 each have a pair of apertures 23 in alignment with the apertures of the opposite bar 22 and spaced apart to register with any of the three pairs of apertures 20 of inclined plane bracket 17. A pair of sturdy removable locking pins 24 is utilized to secure the guide 21 to the bracket 17 in any of the three possible positions of the guide on the bracket 17. The locking pins 24 are equipped near their corresponding ends with detachable retainer pins 25.

The cable guide 21 in its forward side with relation to the jib 13 has an arcuate preferably semi-circular cable seating groove 26 formed by flanges 27. This arcuate groove terminates at the rear edges of side flange extensions 28 which edges lie on a common line through the center of the arcuate groove 26, FIG. 3. The main web 29 of cable guide 21 is spaced slightly above the top face of bracket 17, FIGS. 4 and 5 and may have a rear profiled edge 30, as depicted in FIG. 3, forming spaced rear extensions 31 on the web 29.

In accordance with a key feature of the invention, a single fixed length self-adjusting cable loop or guy 32 has a pair of end clevis connectors 33 fixed thereon which are attached by pins 34 to the two side plates 12 of boom nose assembly 11 at the front upper corner thereof, FIG. 1. The cable loop 32 is trained around the guide 21, as shown in the drawings, and lies in the arcuate groove 26 thereof defined by the flanges 27.

The cable loop is retained in the arcuate groove 26 by preferably three retainer bolts 35, one pair at the sides of the guide through apertures of the flange extensions 28 and a single bolt at the front and center of the guide through apertures of flange extensions 36. The retainer bolts 35 are spaced from and do not bind the cable loop 32 in the arcuate groove 26 so that, when under tension, the cable loop can be self-adjusting with respect to the guide 21 and its groove.

The boom nose assembly 11 on its opposite sides is provided with fixed backstops 37 engageable with coacting backstops 38 on the rear of the jib 13 near its base. These contacting backstops positively limit the rearward or upward swing of the jib 13 to the position shown in full lines in FIG. 1. In this fully raised position of the jib, the axis of the jib assumes an angle of approximately 0°–5° above the axis of the boom 10. As shown in broken lines in FIG. 1, this invention enables offsetting the jib 13 to two angular positions below the position shown in full lines, namely, to positions 15° and 30° below the full line position in FIG. 1. In accordance with the invention, these offset positions of the jib are obtained merely by relocating the cable loop guide 21 on the inclined plane bracket 17, utilizing the several pairs of apertures 20 in the bracket.

As stated, the three illustrated positions of the jib 13 are obtained with the use of the one fixed length cable loop 32 and the described simple adjustment of the guide 21. The upper face of the bracket 17 defines the plane in which the cable loop lies and defines the angle of convergence of the cable loop forwardly with the axis of the jib 13, which angle of convergence remains constant in all adjusted positions of the jib. The angle of convergence defined by the top face of the inclined plane bracket 17 is preferably about 7½° as illustrated.

The operation of the invention can be briefly summarized as follows:

The crane boom 10 is depressed to the lowermost possible position, usually a few degrees below horizontal. With the jib 13 in place on the boom nose assembly in accordance with prior art techniques and projecting forwardly of the depressed boom 10, the forward end of the jib may rest on the ground or on a solid support close to ground level. An installer, standing on the ground, may then place the cable loop guide 21 on the bracket 17 and adjust it thereon by means of the apertures 20 and locking pins 24 to achieve the desired offset position of the jib. The cable loop 32 is engaged with the adjustable guide 21 at the time that the adjustments of the guide on the bracket 17 are made. As illustrated in FIG. 1, the guide 21 is placed in its forwardmost position on the bracket 17 to position the jib 13 in its uppermost position shown in full lines where the backstops 37 and 38 are in contact. In essence, the effective length of the cable loop is shortened in this position to hold the jib in its most elevated position.

With the guide 21 adjusted to the intermediate position, the effective length of the cable loop 32 is increased and the degree of increase enables the taut loop to hold the jib 13 at the 15° position, FIG. 1. Finally, when the guide 21 is in the rearmost position on the bracket 17, the jib will be held by the cable loop 32 in the 30° offset position.

When each required adjustment of the guide 21 is made substantially at ground level, the crane boom 10 is elevated and the weight of the jib will be picked up by the cable loop in the desired offset position as soon as the loop becomes taut by transfer of the jib weight thereto. At this point, the forward end of the jib will rise from the ground or other low temporary support.

The device is characterized by extreme simplicity, ease of installation and adjustment, and economy of manufacturing. The cable loop 32 is self-adjusting with respect to its passage around the arcuate groove of the guide 21 so that equal tension will be imparted to both branches of the cable loop which attach through their connectors 33 to the nose assembly side plates 12.

The terms and expressions which have been employed herein are used as terms of description and not of limitation, and there is no intention, in the use of such terms and expressions, of excluding any equivalents of the features shown and described, or portions thereof, but it is recognized that various modifications are possible within the scope of the invention claimed.

I claim:

1. In a crane boom having a nose assembly and a jib having its base pivotally supported on said nose assembly for swinging movement to multiple offset use positions relative to the axis of said boom, the improvement comprising, a single fixed length of cable for supporting said jib in said selected offset use positions, said cable being reversely bent on itself to form a loop intermediate the ends thereof, the ends of said cable being attached to the nose assembly in spaced relationship to the pivot axis of said jib, a guide element, said cable loop engaging said guide element, mounting means secured to said jib near the forward end thereof, means adjustably connecting said guide element to said mounting means, whereby the guide element can be adjusted relative to the mounting means, while the end of the jib is supported in proximity to the ground, to thereby vary the distance between the cable loop and ends thereof while the cable is slack, thereby adjusting the effective length of the cable loop, whereby the cable loop becomes taut when the crane boom is lifted to thereby support the jib in a selected angular offset position; said mounting means being at a forwardly convergent angle to the axis of the jib and defining a plane in which the cable loop lies when taut and defining an angle of convergence of the cable loop with the axis of the jib which is constant in all offset positions of the jib, whereby crimping of the cable is prevented.

2. In a crane boom having a nose assembly as defined in claim 1, and the constant angle of convergence of the cable loop with the axis of the jib being approximately one-half of the offset adjustment angle of the jib between its several offset positions of use.

3. In a crane boom having a nose assembly as defined in claim 1, and said mounting means comprising a forwardly tapering wedge-like support member having an upper surface and parallel side walls, said guide element for the cable loop resting on said upper surface and having a forward arcuate cable loop guide and retainer groove and having side extensions which straddle said side walls of said wedge-like support member.

4. In a crane boom having a nose assembly as defined in claim 3, and said side walls having multiple longitudinally spaced pairs of adjustment apertures, and said side extensions of the guide element each having a pair of apertures adapted to register selectively with any of the pairs of adjustment apertures of the side walls, and locking pins insertable removably through registering apertures of said extensions and side walls.

* * * * *